US005617910A

United States Patent [19]

Hill

[11] Patent Number: 5,617,910

[45] Date of Patent: Apr. 8, 1997

[54] POSITION CONTROL APPARATUS AND METHOD FOR CONTROLLING THE MOVEMENT OF A BLOCK IN A WOODWORKING MACHINE

[75] Inventor: David A. Hill, Bend, Oreg.

[73] Assignee: Bend Wood Products, Inc., Bend, Oreg.

[21] Appl. No.: 455,020

[22] Filed: May 31, 1995

[51] Int. Cl.[6] ..... B27B 1/00; B27F 1/00; B27C 1/12; B27C 5/06

[52] U.S. Cl. ..... 144/356; 144/2.1; 144/91; 144/242.1; 144/248.4; 144/250.14; 144/250.15; 144/245.1; 144/250.23; 144/347; 156/258; 156/304.5; 198/411; 198/744; 198/811

[58] Field of Search ..... 144/2.1, 3.1, 4.2, 144/90.1, 91, 242.1, 245.1, 246.1, 248.4, 250.14, 250.15, 250.23, 250.26, 329, 347, 348, 356, 357, 359, 361; 156/258, 304.5, 535, 578; 198/341, 411, 740, 744, 811

[56] References Cited

U.S. PATENT DOCUMENTS

| | | |
|---|---|---|
| 2,868,249 | 1/1959 | Taylor . |
| 3,527,274 | 9/1970 | Kramer et al. . |
| 3,927,705 | 12/1975 | Cromeens et al. . |
| 4,128,119 | 12/1978 | Maier . |
| 4,196,760 | 4/1980 | McDaniel et al. . |
| 4,246,943 | 1/1981 | Cromeens . |
| 4,429,784 | 2/1984 | Cromeens . |
| 4,941,521 | 7/1990 | Redekop et al. . |

OTHER PUBLICATIONS

Industrial Woodworking Machine Co., Inc. products brochure.

*Primary Examiner*—W. Donald Bray
*Attorney, Agent, or Firm*—Kolisch, Hartwell, Dickinson, McCormack & Heuser

[57] ABSTRACT

The present invention provides an automatic lug loader to place blocks on each lug on a lug conveyor in a finger jointing machine. The lug loader includes a support structure with a control station and a feed table. A powered loading conveyor overlies the support structure with an infeed end disposed over the control station. The loading conveyor extends downstream to an outfeed end which is disposed over the upstream end of the lug conveyor. A powered adjuster is connected to the loading conveyor and shifts the loading conveyor toward and away from the control station to selectively grip a block. The invention also encompasses an automatic cornering apparatus to transfer blocks from a side-to-side relationship on the lug conveyor to an end-to-end arrangement on a transverse conveyor. The cornering apparatus includes a first conveyor with an upstream end and a downstream end. An elongate support structure extends between the downstream end of the first conveyor and an upstream end of a second conveyor, which extends transversely to the support structure. A third overlying conveyor, having a lower gripping surface, extends between the downstream end of the first conveyor and the upstream end of the second conveyor. A powered adjuster is connected to the third conveyor to move the third conveyor toward and away from the second conveyor to selectively grip or release a block.

20 Claims, 9 Drawing Sheets

POSITION CONTROL APPARATUS AND METHOD FOR CONTROLLING THE MOVEMENT OF A BLOCK IN A WOODWORKING MACHINE

FIELD OF THE INVENTION

This invention relates generally to devices to control the position and movement of boards in woodworking machines. More particularly, the invention is adapted to an apparatus to automatically feed boards to a woodworking machine at controlled intervals and to transfer boards from a side-by-side relationship on one conveyor to an end-to-end relationship on another conveyor.

BACKGROUND OF THE INVENTION

Due to the increasing environmental restrictions on logging and diminishing supplies of high quality old growth timber, the cost of lumber has risen dramatically. In particular, clear lumber, lumber that is free of knots or other defects, has become especially valuable. Because of the increasing cost of natural clear lumber, it is desirable to provide a substitute product formed from lower cost raw material such as low grade lumber, i.e. lumber with knots, cracks, or other defects.

One way to create a long piece of clear lumber is to join small clear pieces together, usually with a joint called a finger joint. This is accomplished by cutting the short clear blocks from longer pieces of low grade lumber and joining those blocks together. The use of finger joints in the assembly of the composite board results in a product that has nearly the same strength as a naturally occurring clear board. This allows lumber that is otherwise only suitable for low value uses to be converted to high value clear lumber.

Small pieces or blocks are normally joined together with the aid of a finger jointing machine. The finger jointing machine mills or cuts fingers into each end of the blocks, applies glue to one or both ends and presses the blocks together so that the fingers on each block interlock, thus forming the final product. Most typically, the blocks are carried through the finger jointing machine on a conveyor that has a number of spaced apart lugs. The boards are placed in a spaced apart side-by-side arrangement, one in front of each lug, and the lugs carry or push the boards through the machine. For maximum efficiency it is important that each lug carry a block through the machine. Any missed lugs result in a reduced output level.

In order to have the highest recovery of clear product from low grade source lumber, it is important that the finger jointing machine be capable of working with blocks of varying length. Currently, finger jointing machines can mill and press together blocks as small as 4" in length. The same machines must also accommodate blocks 36" or longer. In order to avoid the additional step of sorting the short clear blocks into groups of uniform length, the machines are designed to accommodate blocks of assorted lengths in random order, within the above range. Thus a 4" block may directly follow a 30" block, which may in turn be followed by a 16" block. Generally a single sequence of blocks will have the same thickness and width, but a finger jointing machine can usually be set to accept various thicknesses or widths of blocks by some adjustment or modification.

In the past, partially because of the need to accommodate blocks of varying length, a human operator has been required to place each block in front of a lug, attempting to utilize every lug. In addition to being labor intensive and monotonous for the operator, this procedure is far from foolproof and many lugs go unused, thereby reducing efficiency.

After the finger joints are milled in the ends of the blocks, the blocks are placed in an end-to-end relationship on a press conveyor that carries the blocks into a pressing stage. The transfer operation from the lug conveyor to the press conveyor is known as a corner operation since the conveyors typically are oriented transversely to one another. In the past, the corner operation, like the feed operation, required a human operator to pick up each block off the lug conveyor and place it on the transverse conveyor. Thus, transferring the blocks from the lug conveyor to the transverse conveyor has been one of the more labor intensive parts of the process of creating finger jointed boards.

This invention addresses these problems by automating both the loading of the blocks in front of the lugs and the corner operation.

SUMMARY OF THE INVENTION

In order to overcome the need for human operators and increase the efficiency of the finger jointing process by eliminating missed lugs, the present invention provides an automatic lug loader to place blocks on each lug on a lug conveyor in a finger jointing machine. The lug loader includes a support structure with a control station and a feed table. A powered loading conveyor overlies the support structure with an infeed end disposed over the control station. The loading conveyor extends downstream to an outfeed end which is disposed over the upstream end of the lug conveyor. A powered adjuster is connected to the loading conveyor and shifts the loading conveyor toward and away from the control station to selectively grip a block.

The invention also encompasses an automatic cornering apparatus to transfer blocks from a side-to-side relationship on the lug conveyor to an end-to-end arrangement on the transverse conveyor. The cornering apparatus includes a first conveyor with an upstream end and a downstream end. An elongate support structure extends between the downstream end of the first conveyor and an upstream end of a second conveyor, which extends transversely to the support structure. A third overlying conveyor, having a lower gripping surface, extends between the downstream end of the first conveyor and the upstream end of the second conveyor. A powered adjuster is connected to the third conveyor to move the third conveyor toward and away from the second conveyor to selectively grip or release a block.

Both the loader and the corner apparatus of the present invention can accommodate varying length blocks in random order. They also can be set to function with boards of varying width and thickness with minimal readjustment.

DETAILED DESCRIPTION AND BEST MODE OF CARRYING OUT THE INVENTION

Figure 1:
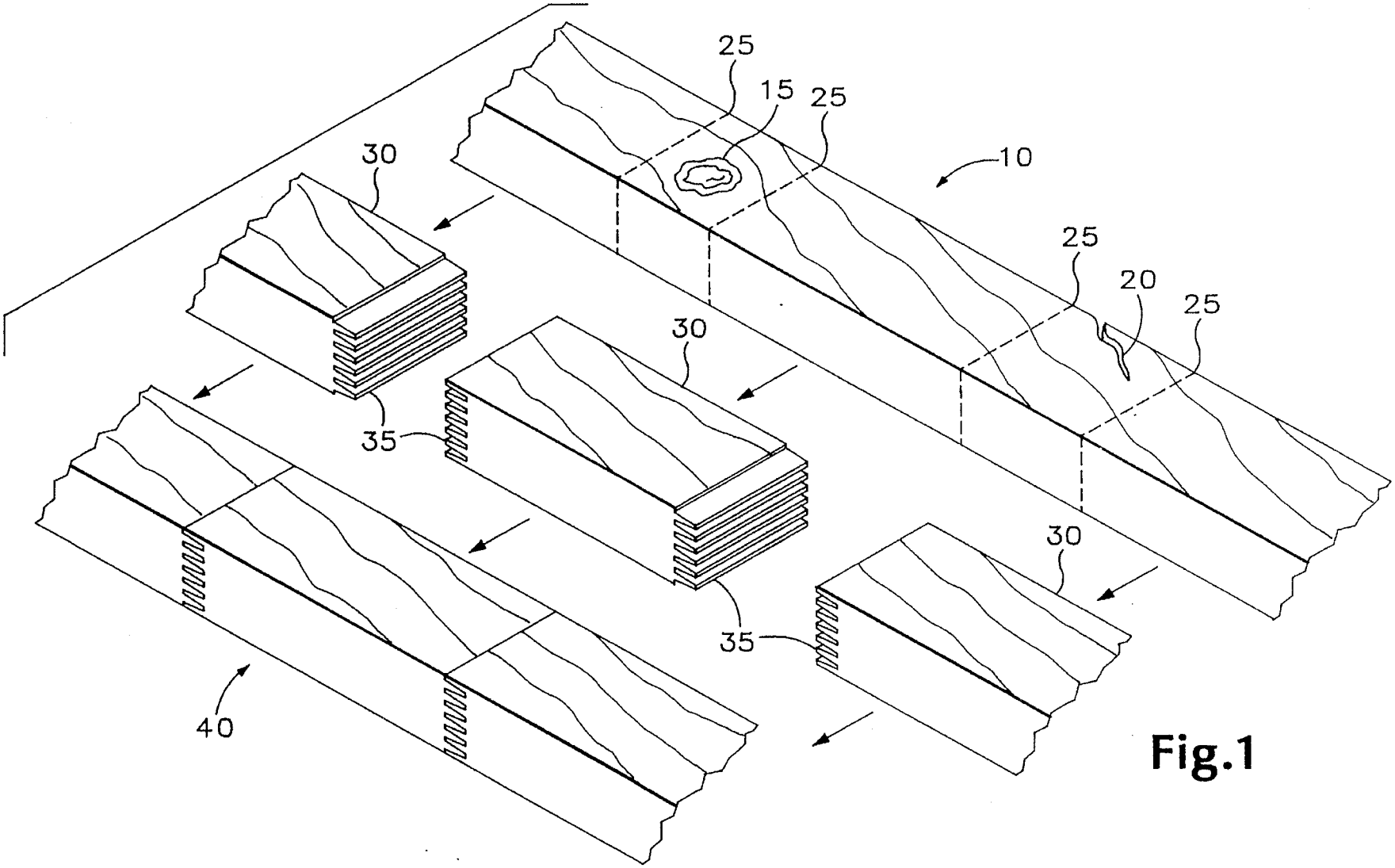
FIG. 1 shows the process of forming a long clear board from a piece of low grade lumber by joining several short blocks together with finger joints.

The steps in producing clear lumber according to the present invention are illustrated in FIG. 1. A long, low grade piece of lumber 10, including a number of defects, such as knots 15 and crack 20, is cut along lines 25 to create a number of short clear blocks 30. A pattern of wedges or fingers 35, known as a finger joint, is milled into the ends of each block 30 and glue is applied to the milled ends. Blocks 30 are then pressed together to form a single long board 40, free of any defects. In practice, blocks 30 may be cut from low grade lumber or they may be recovered remnants or scraps from some other process.

Figures 2A, 2B, 2C, 2D:
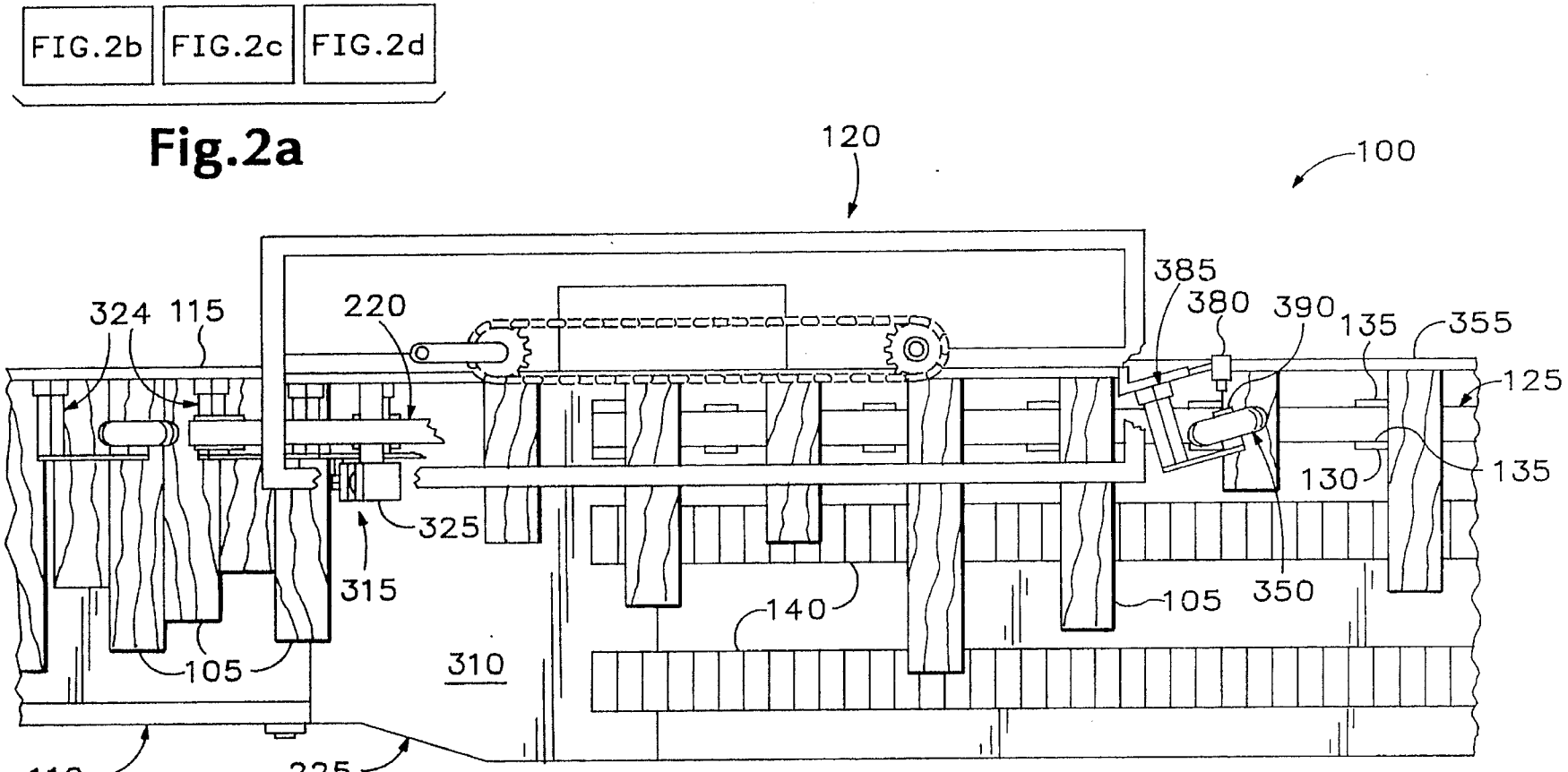
FIG. 2*a* shows the proper arrangement of FIGS. 2*b*–2*d*.
FIGS. 2*b*–2*d* show a top plan view of a finger jointing machine constructed according to the present invention.
Figure 2C:
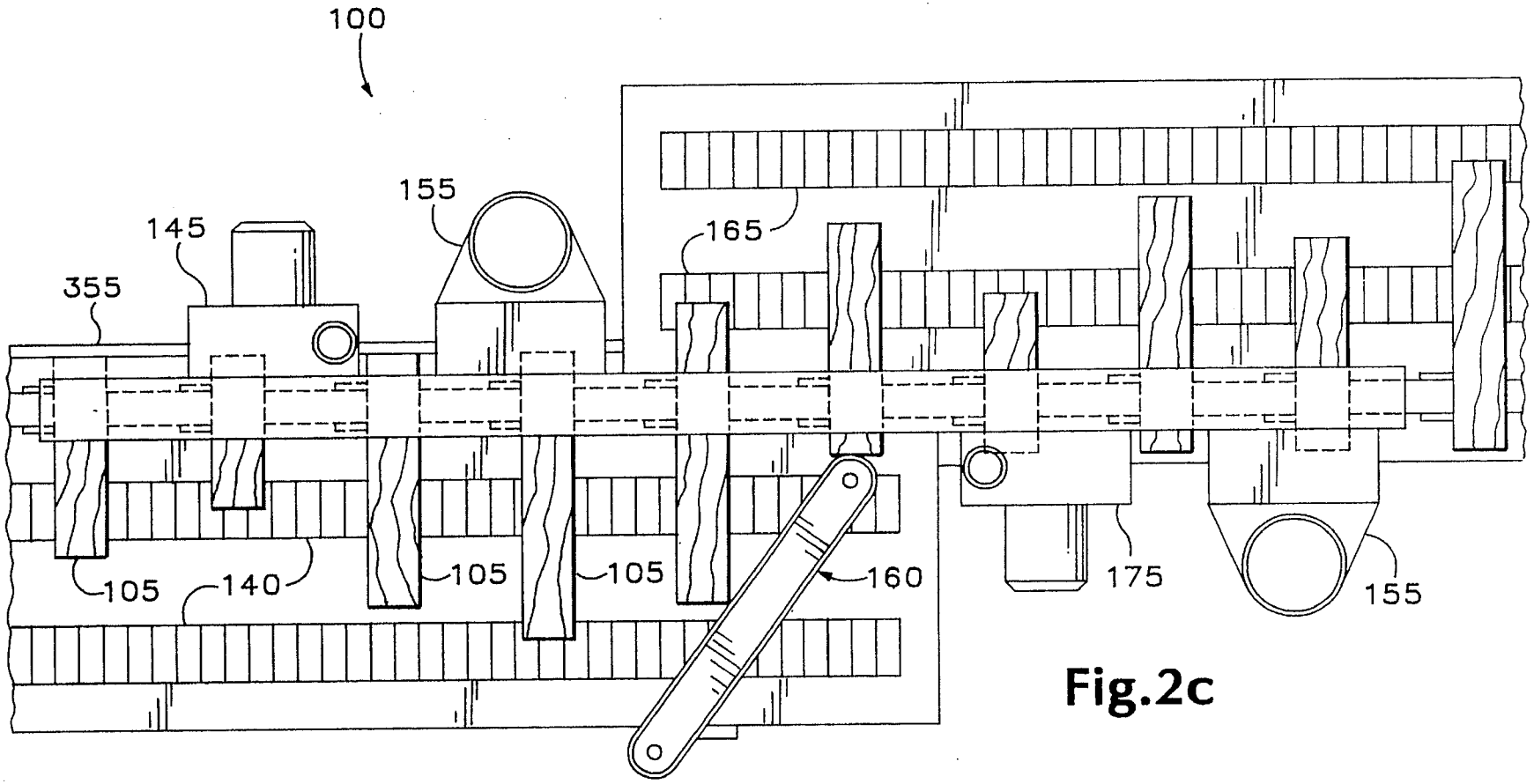
Figure 2D:
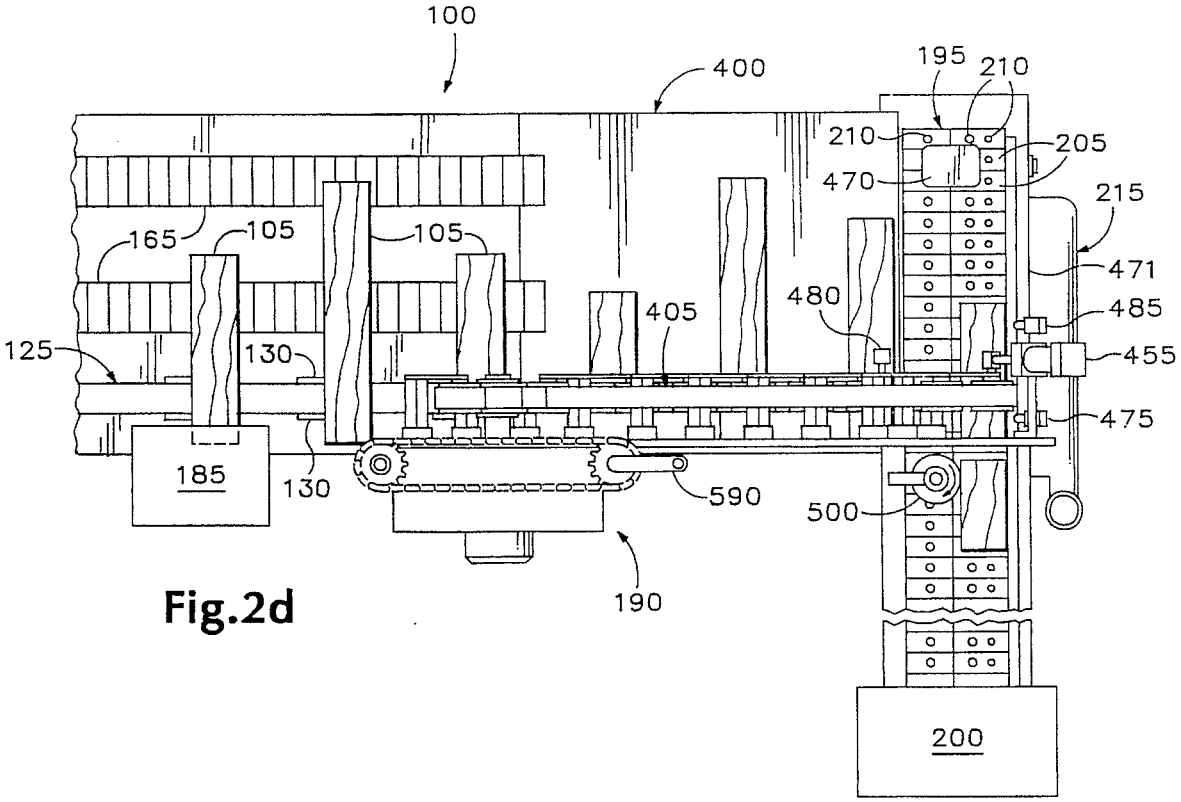

A simplified top view of an automated finger jointing machine constructed according to the present invention is shown generally at 100 in FIGS. 2*b*–2*d*. Finger jointing machine 100 automatically carries out the milling, gluing and pressing steps described above.

A sequence of blocks 105 to be joined are brought to finger jointing machine 100 on an intermittently operable supply conveyor 110 on which they are lined up side-by-side with one end abutting a fence 115. The arrangement of blocks 105 from a supply source onto supply conveyor 110 may be automated but is often done manually.

Blocks generally flow from left to right in FIGS. 2*b*–2*d* with the left end therefore being the upstream end. After being carried to the downstream end of supply conveyor 110, blocks 105 are picked up by an automatic lug loader 120. Loader 120, which is described in more detail below, transports blocks 105 at controlled intervals from supply conveyor 110 to a lug conveyor 125.

Lug conveyor 125 is an endless belt type conveyor that travels in a loop. It includes a number of evenly spaced lugs 130. Each lug includes a pair of spaced-apart, upwardly projecting blades 135. The leading edges of blades 135 in each pair are aligned along a line perpendicular to the direction of travel of lug conveyor 125 to provide an alignment reference for blocks 105. As blocks 105 are pressed against blades 135, they are pivoted into alignment perpendicular to the direction of travel. Blocks 105 are supported from below at one end by the surface of lug conveyor 125. A first pair of support conveyors 140 are laterally spaced from, and extend parallel to, lug conveyor 125 to support the ends of blocks 105 opposite lug conveyor 125. Blocks 105 may be barely longer than the width of lug conveyor 125, or they may be long enough to extend over one or both support conveyors 140. Support conveyors move at the same speed as lug conveyor 125 and are typically driven off the same motor.

Lug conveyor 125 carries blocks 105 past a squaring saw 145 and a scoring saw 150 (shown in FIG. 3*c*) which prepare one end for milling. Squaring saw 145 cuts the end of each block to insure that it is flat and square. Scoring saw 150 cuts a shallow groove across the surface of each block to reduce chipping in the subsequent milling step. Blocks 105 are then carried to a first shaper 155, which is where a finger joint is milled into the prepared end. As lug conveyor 125 continues to move blocks 105 through finger jointing machine 100, the unmilled ends of blocks 105 are engaged by a shifting conveyor 160 which slides blocks 105 transversely across lug conveyor 125 until the unmilled ends are aligned next to blades 135. Shifting conveyor 160 has a vertically oriented face and is angled relative to and extends across lug and support conveyors 125 and 140.

A second pair of support conveyors 165 support the ends of blocks 105 opposite lug conveyor 125 after they are slid across and the unmilled ends are aligned next to lugs 130. Lug conveyor 125 then carries blocks 105 past a second squaring saw 170 (shown in FIG. 3*c*), a second scoring saw 175 and a second shaper 180 (shown in FIG. 3*c*) where the newly aligned ends are prepared and milled with a finger joint.

After both ends are milled, lug conveyor 125 carries blocks 105 past a glue station 185 where glue is applied to the freshly milled ends. Since the blocks are to be joined end-to-end, it is only necessary to apply glue to one end to have glue in every joint. It is also possible, however, to apply glue to both ends if desired. As blocks 105 reach the downstream end of lug conveyor 125, they are received by a corner apparatus 190. Corner apparatus 190, which is described in more detail below, transfers blocks 105 from lug conveyor 125, where they are in a side-to-side relationship, onto transverse conveyor 195, where they are oriented end-to-end.

Transverse conveyor 195 is an endless belt type conveyor formed of a large number of small smooth metal links 205. A number of vacuum holes 210 are formed in the links and vacuum system 215 is then connected to transverse conveyor 195 to draw air through holes 210 to help hold the blocks on the conveyor. The increased grip of transverse conveyor 195 on blocks 105 provided by vacuum system 215 causes blocks 105 to accelerate rapidly to the speed of transverse conveyor 195. It is important that blocks 105 move away from the upstream end of transverse conveyor 195 without delay so that they do not interfere with the placement of subsequent blocks. For short blocks this is not a problem, but for long blocks the upstream end must be carried beyond the downstream end of the next block prior to arrival. Since the blocks may be three feet long and on twelve inch centers on lug conveyor 125, transverse conveyor 195 must move more than three times as fast as lug conveyor 125 to insure that blocks do not interfere with each other. Transverse conveyor 195, therefore, runs at a relatively high speed.

Transverse conveyor 195 carries blocks 105 downstream into a pressing station 200 where they are pressed together into a long board. The long boards thereby formed are automatically cut to length and, if necessary, trimmed to width.

Automatic lug loader 120, mentioned above, is shown in more detail in figures 3*b* and 4. The loader includes a conveying element, which in the preferred embodiment is a loading conveyor 220 disposed over a support structure 225. Loading conveyor 220 is made up of an endless polyurethane belt 230 which travels around a number of support rollers 235. Support rollers 235 are secured to a loading conveyor frame 240 by resiliently biased tensioners 245. Tensioners 245 each include a base 250 which is bolted to frame 240 and a swing arm 255 pivotally attached to base 250 at one end. One of support rollers 235 is attached to the free end of each arm 255. While arm 255 may pivot relative to base 250 as arm 255 travels away from a neutral position, base 250 supplies a restoring torque to resiliently urge arm 255 back to the neutral position. The restoring force increases as the angular displacement of arm 255 is increased. Thus, rollers 235 and tensioners 245 maintain tension on belt 230 as it moves. Suitable tensioners 245 are marketed by a company called Lovejoy.

The largest share of support rollers 235 are disposed in a horizontal linear array 265 to guide belt 230 as it passes over support structure 225 and the upstream end of lug conveyor 125. The track of belt 230 over lug conveyor 125 is centered on lugs 130 between blades 135. Other rollers include a trailing roller 280 supporting the belt above the downstream end of linear array 265 and a roller 270 supporting the belt at the infeed end of loading conveyor 220. The pivotal motion of swing arms 255 allows rollers 235 in linear array 265 to rise and fall slightly as belt 230 drags blocks 105 under rollers 235. Additionally, the restoring torque on arms 255 helps to maintain the tension in belt 230 and the pressure of belt 230 on the upper surfaces of blocks 105. The tension provided by tensioners 245 keeps belt 230 from sagging under linear array 265.

Belt 230 is powered by a drive wheel 290, which is in turn driven by a chain 295 running on a sprocket 300 connected to end roll 305 of lug conveyor 125. This insures a constant speed and position relationship between belt 230 and lug conveyor 125, which is important to the proper loading of lugs 130 as discussed below. Two tension rollers 285 are located on either side of drive wheel 290. Tension rollers 285 are biased to hold belt 230 against drive wheel 290 to insure adequate traction between wheel 290 and belt 230.

Support structure 225 includes a support table 310 which extends from the downstream end of supply conveyor 110 to the upstream end of lug conveyor 125 to form a substantially continuous bridge therebetween. Support table 310 is preferably formed of a flat sheet of metal and should be relatively slick to allow blocks 105 to slide easily over its surface.

Disposed beneath loading conveyor 220 at the upstream end of support structure 225 is a control station 315. Control station 315, shown in detail in FIG. 4, includes a plurality of intermeshing rollers 320 with their upper surfaces substantially aligned with the surface of support table 310. Intermeshing rollers 320 significantly reduce the friction between support structure 225 and blocks 105 at control station 315. Supply conveyor 110 delivers blocks 105 to loader 120 with one end positioned over control station 315 and under loading conveyor 220.

As blocks 105 are transported to the downstream end of supply conveyor 110, two overlying crowding rollers 322 act to remove any gaps and stabilize the blocks as they reach the downstream end. Crowding rollers 322 are each mounted on a tensioner 324 and have a frictional hub inhibiting rotation. Blocks 105 are held back by rollers 322 until several are pushed together, thereby providing sufficient force to rotate the rollers. The roller at the downstream end of supply conveyor 110 also helps to prevent blocks from tipping over the end of the conveyor and catching on the upstream end of support table 310.

Figure 4:
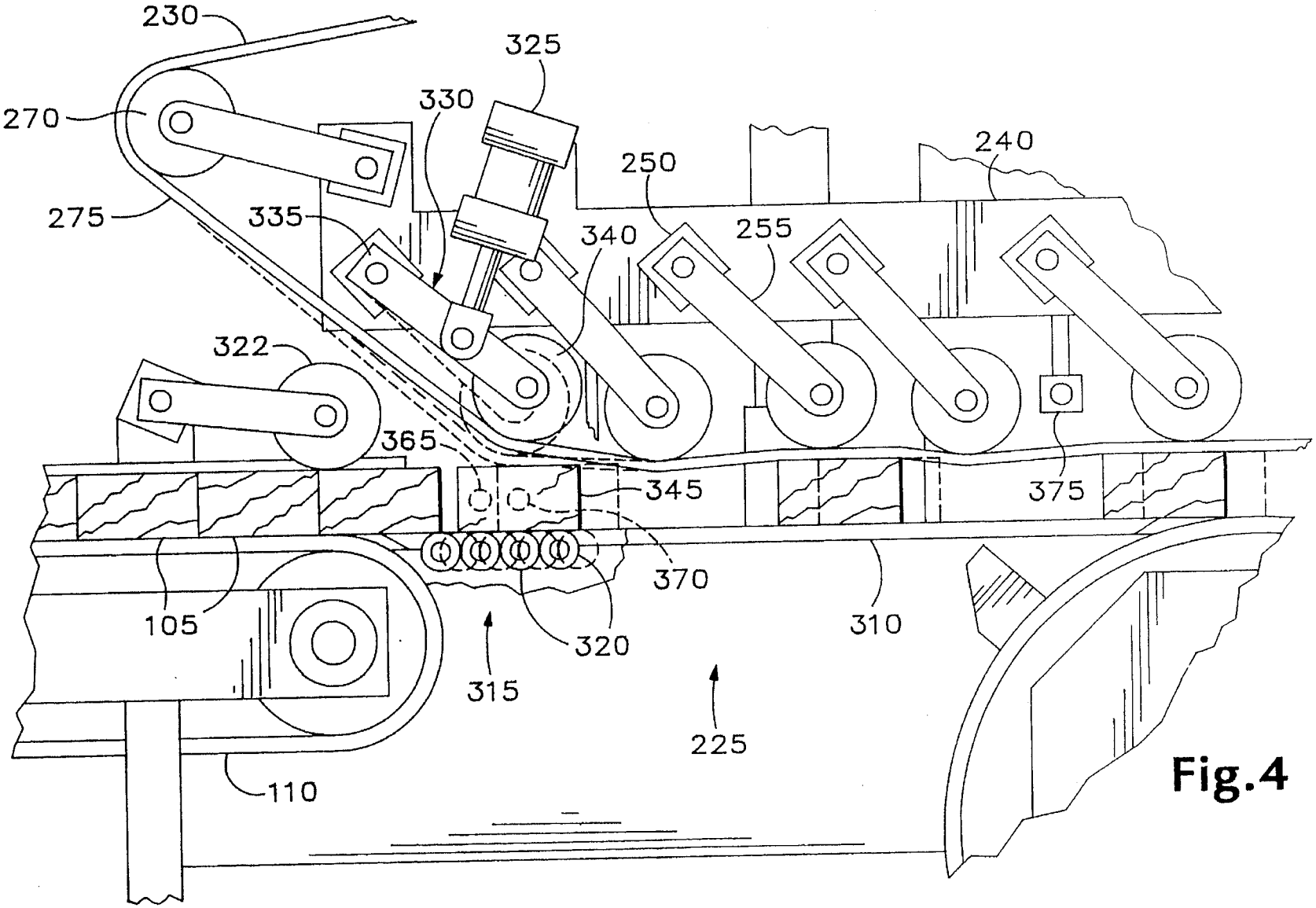
FIG. 4 is a detail view of the upstream end of the lug loader shown in FIG. 3*b*.

A powered adjuster in the form of a pneumatic cylinder 325 is connected to a leading tensioner 330 in linear array 265 to form a feeder for sequentially and successively feeding blocks into the machine. Hydraulic, electric or other cylinders may be used instead of a pneumatic cylinder. Cylinder 325 is connected to a swing arm 335 on leading tensioner 330 to raise and lower the associated guide roller 340, which in turn raises and lowers belt 230 over control station 315 as shown in FIG. 4. Belt 230 tracks with roller 340 because of the tension supplied and maintained by tensioners 245, which take up any slack created when the belt is raised and lowered over control station 315.

As long as cylinder 325 is retracted and belt 230 is raised, a block 345 sitting between control station 315 and belt 230 will remain there, since nothing will propel it forward. However, when cylinder 325 is extended, the path of belt 230 is changed, causing it to contact the upper surface of block 345. Caught between belt 230 and rollers 320, block 345 begins to travel with belt 230, as indicated by the dashed lines in FIG. 4. Block 345 passes off of rollers 320 and continues with belt 230, sliding over the surface of support table 310 until it reaches lug conveyor 125.

The portion of belt 230 between roller 270 and roller 340 forms an inclined region 275. Inclined region 275 reduces the force required to raise and lower belt 230 over control station 315.

Cylinder 325 is actuated in synchronization with lug conveyor 125 to insure that blocks 105 are delivered to lug conveyor 125 with one being delivered in front of each of lugs 130. Belt 230 moves at a slower speed than lug conveyor 125, thereby allowing lugs 130 to catch blocks 105 moving with belt 230, as shown in FIG. **3*b*. This speed differential reduces the precision required in the timing of actuation of cylinder 325. Cylinder 325 can be actuated to deliver blocks 105 roughly half way between each pair of lugs 130. Lugs 130 will then catch blocks 105 as belt 230 and lug conveyor 125 progress. As an added benefit, when lugs 130 catch blocks 105, blocks 105 are urged back against lugs 130 by the action of the slower moving belt 230. This corrects any angular misalignment and makes blocks 105 properly perpendicular to lug conveyor 125**.

A positioning wheel 350 just downstream from the downstream end of loading conveyor 220, as shown in FIG. **3*b*, further promotes alignment of blocks 105. The track of wheel 350 is angled slightly toward a fence 355 against which the ends of blocks 105 are abutted prior to milling. As blocks 105 pass under wheel 350, they are urged toward fence 355. Wheel 350 has a moderate amount of drag inhibiting free rotation so that blocks 105 are further driven back against lugs 130 as they pass underneath wheel 350**.

The timing and operation of cylinder 325, supply conveyor 110 and lug conveyor 125 are regulated by a control system that processes inputs from several sensors. The sensors are reflected light photo-detectors in the preferred embodiment, but could also be beam interruption photo-detectors or even mechanical switches. The signal from a supply sensor 365 disposed beside control station 315 is used to trigger the intermittent operation of supply conveyor 110. Supply conveyor 110 is triggered to operate any time supply sensor 365 does not detect a block over control station 315. Therefore, as soon as loading conveyor 220 moves one block downstream away from control station 315, supply sensor 365 sends a signal which triggers supply conveyor 110 to start moving to deliver another block.

After belt 230 is lowered and the block currently over control station 315 starts to move, a clear sensor 370, positioned adjacent to supply sensor 365, signals when the block has cleared control station 315. This notifies the control system that it is time to raise belt 230 to prepare for the next block. If belt 230 is not raised as soon as possible, the block being delivered by supply conveyor 110 to control station 315 will be engaged immediately by belt 230, which would result in the second block following too closely behind the first block. Since only a small portion of belt 230 near the upstream end is raised and lowered, blocks that have started to move with the belt will continue to be drawn with it, even when the portion of the belt over the control station is raised. Both supply sensor 365 and clear sensor 370 are mounted so that they can side back and forth to compensate for differing width boards and achieve proper operation. In order to avoid obscuring sensors 365 and 370, the upstream block under belt 230 has been omitted in FIGS. 2*b* and 3*b*. It should be understood that an additional block would normally follow the downstream blocks at equally spaced intervals under belt 230. As an alternative to using two sensors, a signal from one sensor can be used in conjunction with a delay timer to monitor the position of boards and determine when to raise the belt and move the next block into position.

A first misfeed sensor 375 is disposed above the upstream end of lug conveyor 125. Misfeed sensor 375 is triggered if a block arrives at the upstream end of lug conveyor 125 just as one of lugs 130 rises around end roll 305. If this happens, the block will be lifted by the lug and detected by the sensor. A second misfeed sensor 380 is disposed over positioning wheel 350 to detect overly thick blocks. Positioning wheel 350, which is mounted on a resilient tensioner 385, normally raises and lowers slightly as blocks 105 pass underneath. If, however, an overly thick block passes under positioning wheel 350 it will be raised sufficiently that an attached tab 390 will trigger second misfeed sensor 380. If either misfeed sensor 375 or 380 signals the control system of an irregularity, loader 120, supply conveyor 110 and lug conveyor 125 will stop.

Figures 3A, 3B:
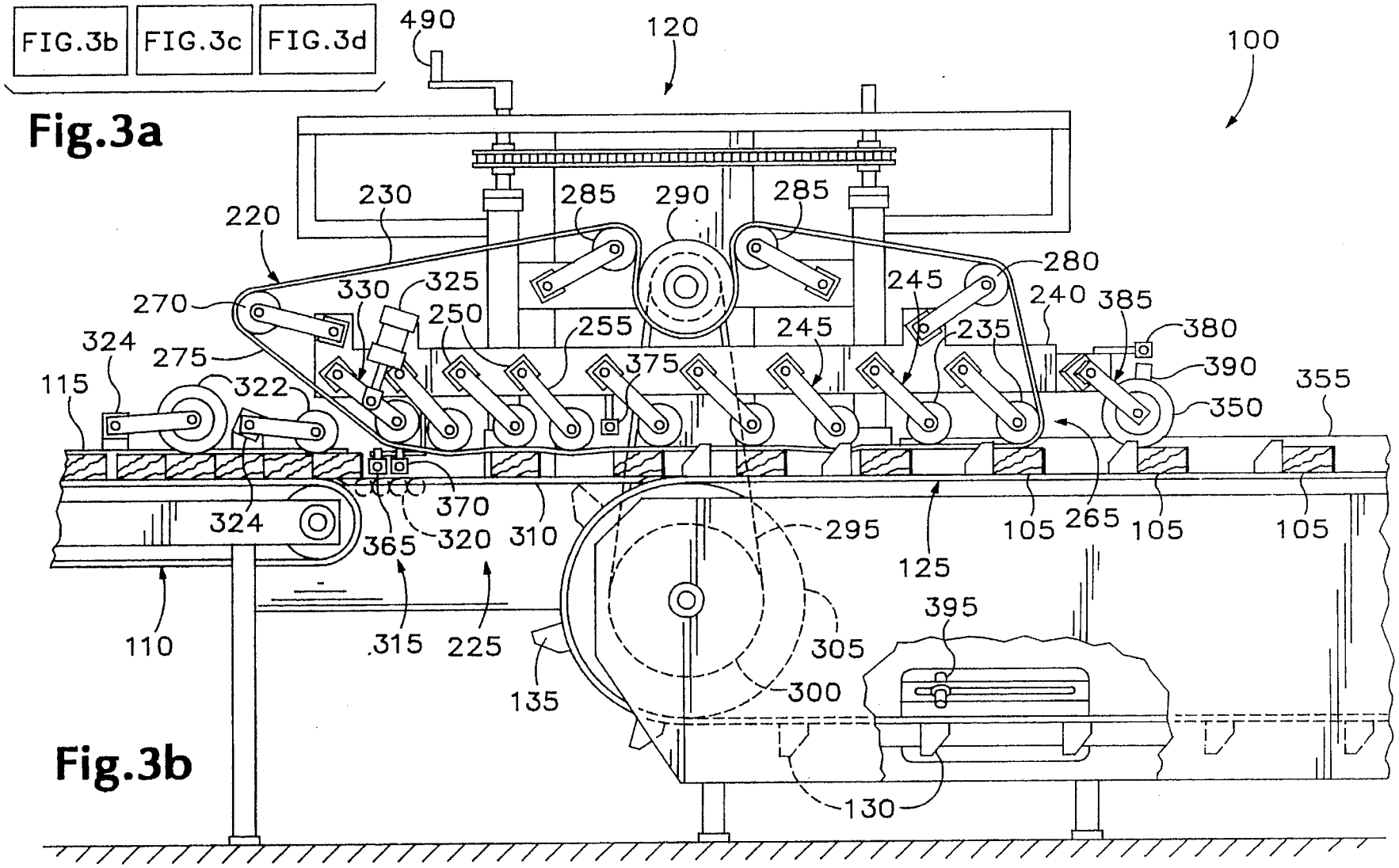
FIG. 3*a* shows the proper arrangement of FIGS. 3*b*–3*d*.
FIGS. 3*b*–3*d* show side views of the portions of the finger jointing machine shown in FIGS. 2*b*–2*d*, respectively.
Figure 3C:
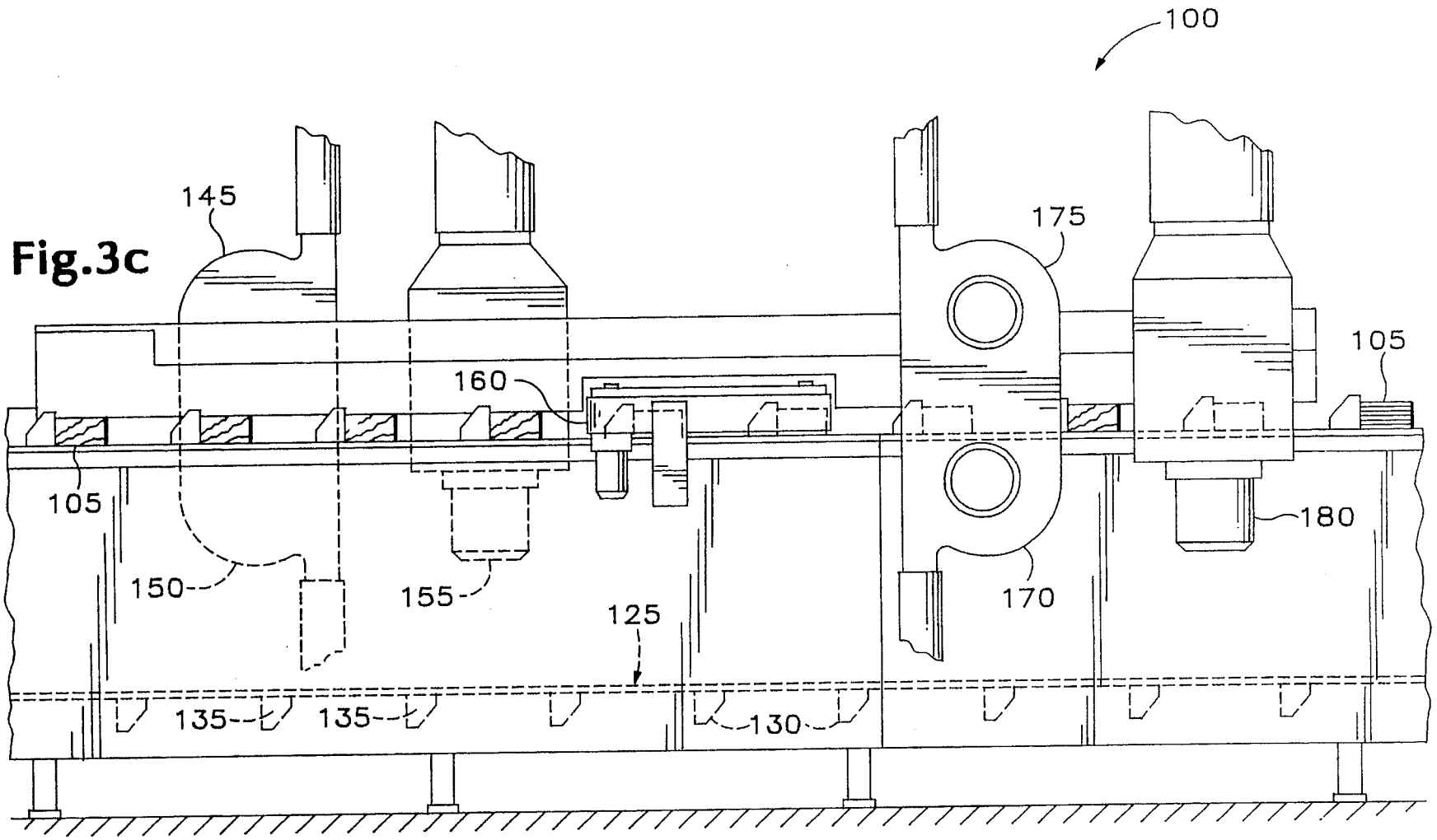

As discussed above, the actuation of cylinder 325 is timed to start blocks 105 moving so that one arrives at lug conveyor 125 between each pair of lugs 130. In order to achieve this result, it is necessary to track the positions of lugs 130. This is accomplished by a lug tracking sensor 395 disposed to detect lugs 130 on the returning portion of lug conveyor 125, as shown in FIG. 3*b*. Given the speed of lug conveyor 125, the lug spacing and the position of a lug as signalled by tracking sensor 395, it is possible to determine how long it will be until subsequent lugs 130 arrive at the upstream end of lug conveyor 125. The control system, taking into account the speed of belt 230, actuates cylinder 325 so that a block will arrive between each pair of lugs 130.

In the event of a supply interruption on the supply conveyor it may happen that no block is available at the control station 315 for loading conveyor 220 to deliver to the next available lug. When the supply is restored, the control system will determine if there is sufficient time for the block to be delivered in front of the next arriving lug. If there is not sufficient time, given the speed of the loading conveyor and the current location of the lug, the control system will delay actuating cylinder 325. The control system will time the actuation of cylinder 325 so that the block will arrive in front of the lug after the next lug.

Figure 3D:
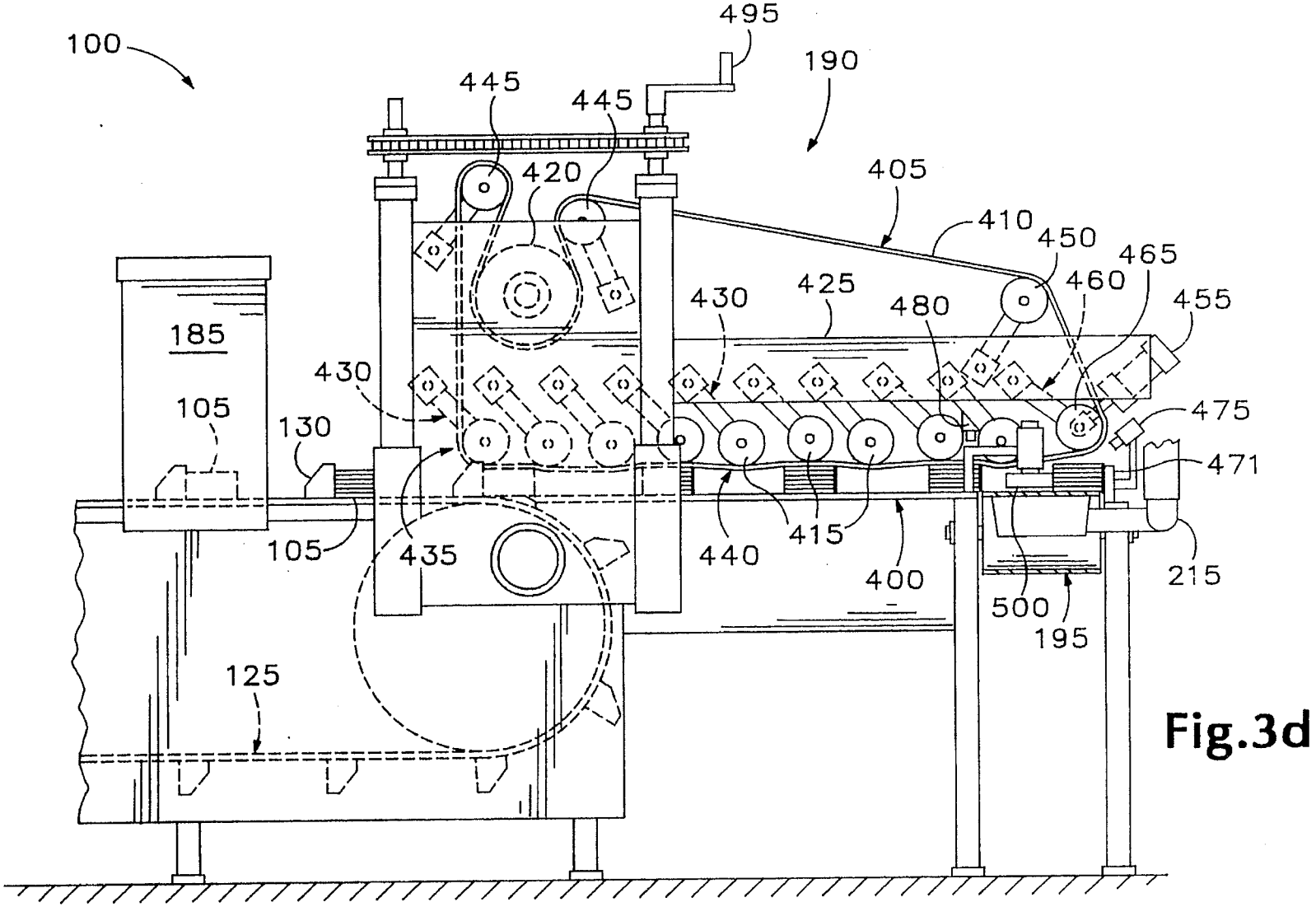

After blocks 105 are loaded on lug conveyor 125, milled on both ends and glue has been applied to one end, they are ready to be pressed together, end-to-end, to form a long clear board. As discussed generally above and as shown in FIG. 3*d* , corner apparatus 190 receives blocks 105 from the downstream end of lug conveyor 125 and transfers them to transverse conveyor 195.

Corner apparatus 190 includes an elongate support structure 400 with an upstream end adjacent the downstream end of lug conveyor 125. Support structure 400 further includes a downstream end disposed adjacent the side of the upstream end of transverse conveyor 195, thereby forming a substantially continuous bridge between the downstream end of lug conveyor 125 and the upstream end of transverse conveyor 195. In the preferred embodiment, support structure 400 is formed of a sheet of flat smooth metal.

A transfer conveyor 405, similar in construction and operation to loading conveyor 220, overlies the downstream end of lug conveyor 125 and extends across support structure 400 to the upstream end of transverse conveyor 195. Transfer conveyor 405 is formed by an endless rubber belt 410 riding on a number of support rollers 415 and driven by a drive wheel 420. Two tension rollers 445 disposed on either side of wheel 420 insure that belt 410 has sufficient contact with wheel 420. Support rollers 415 are mounted to a transfer conveyor frame 425 by the same type of tensioner 430 as used in loading conveyor 220. A horizontal linear array 435 of rollers 415 is disposed to support belt 410 as it extends between lug conveyor 125 and transverse conveyor 195 to create a lower gripping surface 440. Another roller 450 supports belt 410 above the downstream end of linear array 435.

A pneumatic cylinder 455 is connected to a tensioner 460 supporting a roller 465 at the downstream end of linear array 435. Cylinder 455 reciprocally drives roller 465 and belt 410 up and down over transverse conveyor 195 upon actuation. Hydraulic, electric or other cylinders may also be used.

In operation, lower gripping surface 440 of belt 410 engages the upper surface of blocks 105 as they arrive at the downstream end of lug conveyor 125. Blocks 105 are then drawn across support structure 400 to transverse conveyor 195. A small amount of light oil may be dripped on transverse conveyor 195 from oil reservoir 470 to prevent accumulation of glue dripping from the glued ends of blocks 105.

Figure 5:
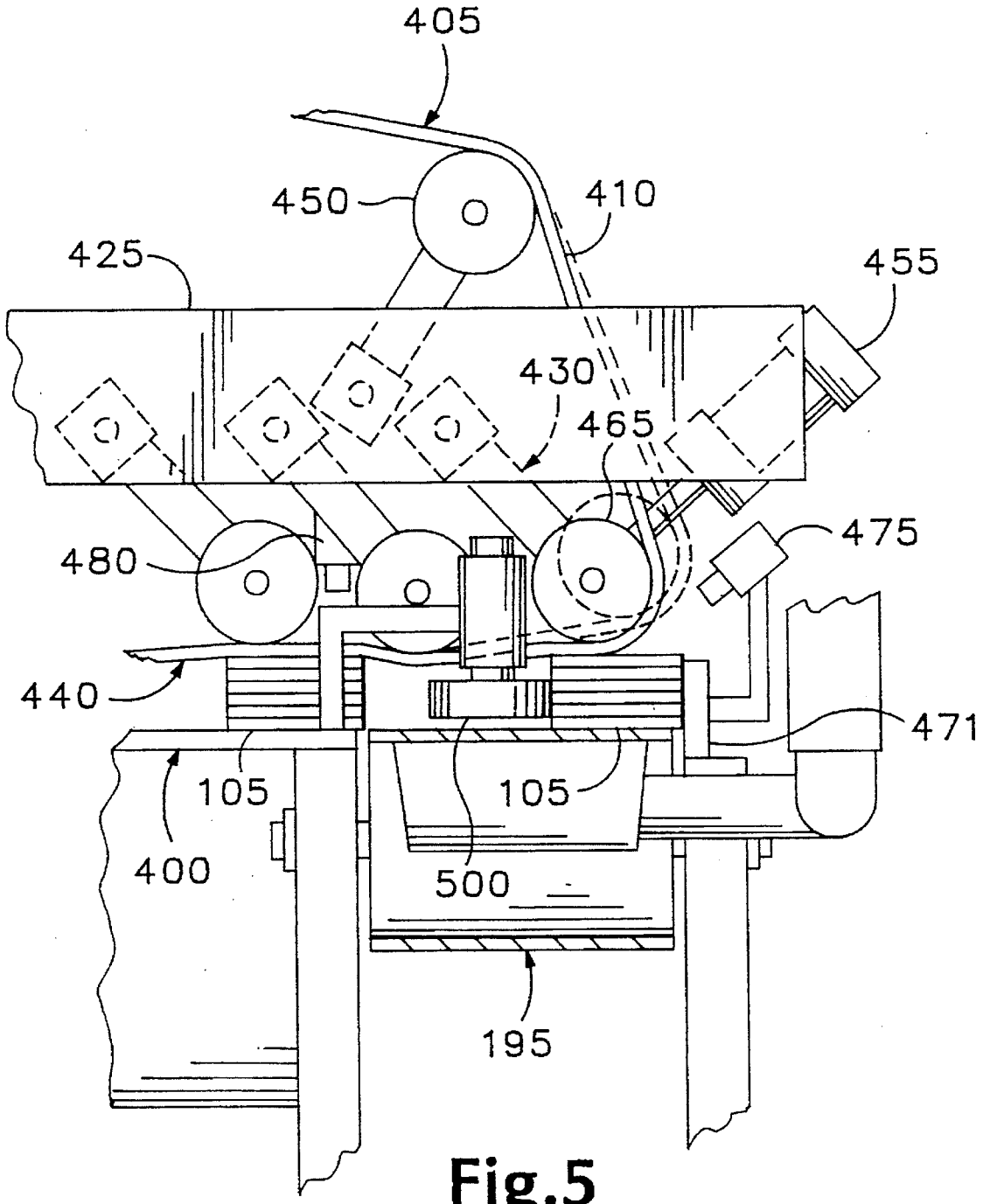
FIG. 5 is detail view of the downstream end of the corner apparatus of the present invention shown in FIG. 3*d*.

After crossing support structure 400, belt 410 carries blocks 105 onto transverse conveyor 195. Transverse conveyor 195, which runs continuously, slides by underneath blocks 105 as long as belt 410 is held firmly against the upper surface of the blocks. As soon as belt 410 has transported blocks 105 to a fence 471 at the far side of transverse conveyor 195, cylinder 455 is actuated to alter the track of belt 410 by raising it over blocks 105, as shown by the dashed lines in FIG. 5. When belt 410 is raised blocks 105 are released to begin travelling with transverse conveyor 195.

A drive wheel 500 is positioned just downstream on transverse conveyor 195 from belt 410. Drive wheel 500 is spring biased toward fence 471, thereby urging blocks 105 firmly against the fence. In addition, drive wheel 500 supplies force to accelerate blocks 105 up to the speed of transverse conveyor 195.

The control system monitors a positioning sensor 475, shown in FIG. 2*d*, disposed over transverse conveyor 195 just downstream from the downstream end of belt 410 to control the actuation of cylinder 455. Positioning sensor 475 detects blocks 105 as they arrive against fence 471. When the control system receives a signal from positioning sensor 475 indicating that a block is in position against the fence, it actuates cylinder 455 to raise belt 410, thereby releasing the block. The control system keeps belt 410 raised until positioning sensor 475 no longer detects a block, indicating that the block has cleared belt 410.

A first misfeed sensor 480, also shown in FIG. 2*d*, is positioned slightly upstream on transverse conveyor 195 from positioning sensor 475. In normal operation, blocks 105 intermittently pass in front of misfeed sensor 480 and remain for a short time before moving down transverse conveyor 195. Only if there is some type of interruption in the flow of blocks 105 will misfeed sensor 480 detect a block for more than a short interval of time. Therefore, if misfeed sensor 480 detects a block for more than a few moments, the control system shuts down lug conveyor 125.

A second misfeed sensor 485, shown in FIG. 2*d*, is disposed over support structure 400 and operates in a fashion similar to first misfeed sensor 480. Under normal circumstances, blocks 105 pass by misfeed sensor 485 at regular intervals. In the event of some disruption in flow, however, second misfeed sensor 485 may detect a single block for an extended period of time. As before, if this happens, the control system will shut down lug conveyor 125.

A crank 490 located above loader 120 and a crank 495 located above corner apparatus 190 is used to raise and lower loader and corner apparatus, respectively, to accommodate various thickness blocks, as shown in FIGS. 3*b* and 3*d* .

INDUSTRIAL APPLICABILITY

The invented position control method and apparatus are ideally suited for use with finger jointing machines. However, it is anticipated that they could also be beneficially applied to other types of woodworking machines. In particular, the automatic loader should be easily adaptable for use with tensioning machines, such as an automated double end tenoner.

While the invention has been disclosed in its preferred form, it is to be understood that the specific embodiment thereof as disclosed and illustrated herein is not to be considered in a limited sense and changes or modifications may be made thereto without departing from the spirit of the invention.

I claim:

1. A position control apparatus to control the movement of a workpiece in association with a woodworking machine, the apparatus comprising:

a frame;

a support structure mounted on the frame and including a control station;

a traveling conveying element mounted on the frame in a spaced apart and opposed relationship with the support structure at the control station; and a powered adjuster coupling the control station and the conveying element and operable on actuation to selectively increase and decrease the spacing between the control station and the conveying element to alternatively release and grip the workpiece.

2. The apparatus of claim 1 where the support structure includes a feed table opposed to the conveying surface and the workpiece slides on the feed table when gripped between the feed table and the conveying surface.

3. The apparatus of claim 1 where the control station includes at least one roller disposed opposite the conveying surface.

4. The apparatus of claim 1 where the conveying surface is the face of a first endless belt conveyor.

5. The apparatus of claim 4 where the control station comprises the face of an elongate second conveyor opposed to and extending transversely of the first endless belt conveyor.

6. An automatic loader to load boards into a woodworking machine at controlled intervals comprising:

a support structure including a control station and a feed table downstream of the control station;

a powered loading conveyor overlying the support structure and having an infeed end overlying the control station and an outfeed end;

a powered adjuster connected to the loading conveyor and reciprocally operable on actuation to shift the loading conveyor toward and away from the control station at the infeed end to selectively grip the workpiece and load it into the machine.

7. The loader of claim 6 further comprising an intermittently operable supply conveyor with a downstream end adjacent to the control station to deliver boards to the control station as required.

8. The loader of claim 7 further comprising a control system including at least one board detector to register the presence or absence of a board in the control station, where the control system triggers the supply conveyor to operate at least a portion of the time when the board detector does not register a board in the control station.

9. The loader of claim 8 where the woodworking machine includes a lug conveyor with a series of spaced apart lugs on the surface for engaging boards to be carried into the machine and the control system further includes a lug tracker to keep track of the position of lugs on the lug conveyor and the control system controls operation of the powered adjuster to shift the loading conveyor toward the control station based on the position of the lugs, thereby gripping each board to deliver it to the lug conveyor to coincide with the arrival of a lug.

10. The loader of claim 6 wherein the loading conveyor rides on a roller at the infeed end and the powered adjuster is connected to the roller to shift it toward and away from the control station.

11. The loader of claim 10 wherein the powered adjuster is a pressure cylinder.

12. The loader of claim 10 wherein the loading conveyor extends across the feed table and the spacing between the loading conveyor and the feed table is substantially constant and fixed.

13. A position control apparatus to transfer elongate blocks from a side-by-side relationship to an end-to-end relationship, the apparatus comprising:

an elongate first conveyor for conveying boards, the first conveyor having upstream and downstream ends;

an elongate support structure having upstream and downstream ends with the upstream end of the support structure adjacent to the downstream end of the first conveyor and forming an extension of the first conveyor;

an elongate second conveyor extending transversely of the support structure and having upstream and downstream ends with the upstream end of the second conveyor proximal to the downstream end of the support structure;

an elongate third conveyor having a lower gripping surface overlying the support structure and having an upstream end overlying the downstream end of the first conveyor and a downstream end overlying the upstream end of the second conveyor; and a powered adjuster connected to the third conveyor and operable on actuation to shift the third conveyor toward and away from the second conveyor for the purpose of gripping and releasing boards.

14. The apparatus of claim 13 further comprising a control system to selectively actuate the powered adjuster including at least one position detecting device disposed to register the position of boards as they pass through the apparatus.

15. A finger jointer for joining boards together automatically, comprising:

an elongate support structure for supporting boards deposited thereon;

an elongate lug conveyor with upstream and downstream ends and lugs distributed along the length of the lug conveyor, the upstream end forming a continuation of the support structure; and at least one shaper disposed along the lug conveyor;

an elongate power-operated loading conveyor overlying the support structure and at least a portion of the lug conveyor having an upstream end and a downstream end and operable to convey boards along the support structure by engaging upper surfaces of the boards;

a selectively operable feeder for intermittently feeding boards onto the support structure with the boards then being gripped between the loading conveyor and the support structure;

a control system to control the timing of operation of the feeder to place boards onto the support structure at intervals so that the loading conveyor conveys each board to the lug conveyor to arrive just in front of a lug; and a pressing station adjacent to the downstream end of the lug conveyor.

16. The finger jointer of claim 15 where the feeder comprises a powered adjuster connected to the upstream end of the loading conveyor and operable on actuation by the control system to shift the upstream end of the loading conveyor toward and away from the underlying support structure, thereby co-acting with the support structure to grip boards and start them toward the lug conveyor when the loading conveyor is shifted toward the support structure.

17. The finger jointer of claim 16 where the feeder further comprises an intermittently operable supply conveyor with a downstream end proximal to the upstream end of the loading conveyor to deliver boards one at a time to the upstream end of the loading conveyor between the loading conveyor and the support structure.

18. A method of loading blocks into a woodworking machine comprising:

arranging blocks side-by-side on a first conveyor;

advancing the first conveyor so that a leading block is delivered to a predetermined position underneath, but not touching, a second conveyor; and changing the path of the second conveyor at a selected time to contact it with the underlying leading block; and moving the leading block into the machine with second conveyor.

19. The method of claim 18 where the second conveyor loads the blocks into the machine onto a third conveyor in a side-by-side relationship and further comprising transferring the blocks from the side-by-side relationship on a third conveyor into and end-to-end relationship on a fourth conveyor.

20. The method of claim 19 wherein the transferring includes:

engaging the blocks with a fifth conveyor which extends between and overlies the downstream end of the third conveyor and the upstream end of the fourth conveyor to move them from the third conveyor to the fourth conveyor; and changing the path of at least a portion of the fifth conveyor overlying the fourth conveyor to release the blocks when they reach a predetermined position on the fourth conveyor.

* * * * *